US007717414B2

(12) United States Patent
Ooshiro

(10) Patent No.: US 7,717,414 B2
(45) Date of Patent: May 18, 2010

(54) SHEET PROCESSING APPARATUS AND SHEET PROCESSING METHOD

(75) Inventor: Toshiaki Ooshiro, Izu (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 616 days.

(21) Appl. No.: 11/670,078

(22) Filed: Feb. 1, 2007

(65) Prior Publication Data

US 2008/0185766 A1 Aug. 7, 2008

(51) Int. Cl.
*B65H 37/04* (2006.01)

(52) U.S. Cl. ..... 270/58.27; 270/58.07; 270/58.04; 270/58.17

(58) Field of Classification Search ..... 270/58.01, 270/58.04, 58.07, 58.17, 58.27; 271/10.01, 271/10.05, 10.09, 37, 110, 111, 114, 115, 271/117, 118, 125

See application file for complete search history.

(56) References Cited

U.S. PATENT DOCUMENTS 5,316,285 A * 5/1994 Olson et al. ..... 271/122
6,135,444 A * 10/2000 Padget ..... 271/121

FOREIGN PATENT DOCUMENTS

| | | |
|---|---|---|
| JP | 09-048531 | 2/1997 |
| JP | 10-186741 | 7/1998 |
| JP | 2001-270653 | 10/2001 |

* cited by examiner

*Primary Examiner*—Gene Crawford
*Assistant Examiner*—Leslie A Nicholson, III
(74) *Attorney, Agent, or Firm*—Turocy & Watson, LLP

(57) ABSTRACT

A sheet processing apparatus according to the invention includes a sheet feeding tray capable of aligning and storing plural sheets, a discharging member that discharges a sheet at the top of a bundle of the sheets aligned from the sheet feeding tray, and a retracting member that moves the sheet at the top of the sheet bundle in a direction opposite to a direction of the discharge. When plural pieces of plural types of sheets are stored in the sheet feeding tray, the sheet processing apparatus controls the operations of the discharging member and the retracting member, discharges, for each of the types, a sheet located at the top of the sheet feeding tray and retracts the remaining sheets, performs alignment again at a point when the discharge and the retraction are finished for all the types, and repeats the operations to sequentially discharge the sheets of the respective types.

14 Claims, 6 Drawing Sheets

SHEET PROCESSING APPARATUS AND SHEET PROCESSING METHOD

BACKGROUND OF THE INVENTION

1. Field of the Invention

The present invention relates to a sheet processing apparatus that feeds a sheet having an image formed thereon by a copying machine, a printer, a multifunction peripheral (MFP), or the like to a finisher and has a collating function.

2. Description of the Related Art

In recent years, among image forming apparatuses, there is an image forming apparatus in which a finisher is provided adjacent to an image forming apparatus main body in order to perform post-processing such as processing for sorting sheets after image formation and processing for applying staple processing to the sheets. An inserter may be arranged at a pre-stage of the finisher in order to feed sheets having images formed thereon to the finisher.

In a general inserter, since a user needs to arrange orders of sheets to be inserted in advance and insert the sheets, a burden is imposed on the user.

In JP-A-2001-270653, a collating device is described. In this example, prints are supplied from plural printing machines to plural trays on a belt conveyor, respectively, and the prints received by the trays are collected and stacked to collate the prints. However, in this example, since the plural trays and the belt conveyor are necessary, the apparatus is large in scale.

In JP-A-10-186741, an original conveying apparatus that copies plural originals by the number n and sorts the copies is described. In this example, a system for varying discharge speed at the time when a first sheet is discharged and at the time when second to nth sheets are discharged on the basis of the number of copies n is adopted.

However, since it is necessary to frequently switch discharge speed of the sheets, a structure of the apparatus is complicated.

Moreover, in JP-A-9-48531, a supplying apparatus that supplies sheets to a collating machine to bind the sheets is described. This example is a large-scale apparatus for bookbinding.

The present invention provides a sheet processing apparatus and a sheet processing method that can classify sheets into predetermined states and discharge the sheets.

DETAILED DESCRIPTION OF THE INVENTION

Figure 1:
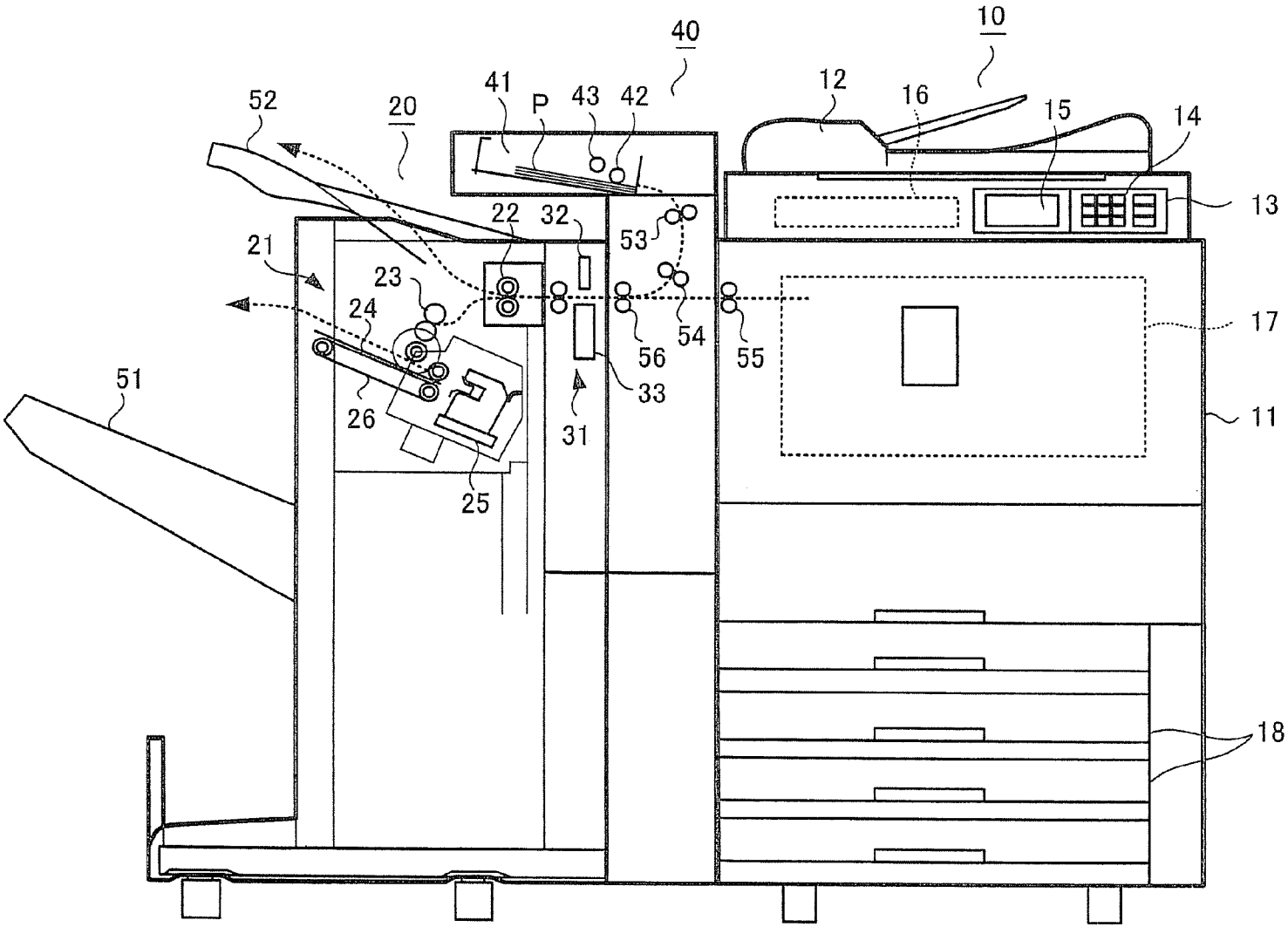
FIG. 1 is a schematic diagram showing a sheet processing apparatus according to an embodiment of the invention.

Throughout this description, the embodiments and examples shown should be considered as exemplars, rather than limitations on the apparatus of the present invention.

An embodiment of the invention will be hereinafter explained in detail with reference to the drawings. In the respective figures, identical components are denoted by identical reference numerals and signs.

FIG. 1 is a diagram showing an embodiment of a sheet processing apparatus of the invention. In FIG. 1, reference numeral 10 denotes an image forming apparatus, which is, for example, an MFP (Multi-Function Peripherals) as a complex machine, a printer, and a copying machine.

An original stand (not shown) is provided above a main body 11 of the image forming apparatus 10. An auto document feeder (ADF) 12 is provided to be opened and closed freely on the original stand. An operation panel 13 is provided on the main body 11. The operation panel 13 has an operation unit 14 including various keys and a display unit 15 of a touch panel type.

The main body 11 has a scanner unit 16 and a printer unit 17 in the inside thereof. Plural cassettes 18 having sheets of various sizes stored therein are provided below the main body 11. The scanner unit 16 scans an original sent by the ADF 12 or an original placed on the original stand.

The printer unit 17 includes a photoconductive drum and a laser, scans and exposes the surface of the photoconductive drum with a laser beam from the laser, and forms an electrostatic latent image on the photoconductive drum. A charging device, a developing device, a transfer device, and the like are arranged around the photoconductive drum. The electrostatic latent image on the photoconductive drum is developed by the developing device and a toner image is formed on the photoconductive drum. The toner image is transferred onto a sheet by the transfer device.

A constitution of the printer 17 is not limited to the above example. There are various systems as the constitution of the printer 17. A finisher 20 is arranged on a sheet discharge side of the image forming apparatus 10. A sheet having an image formed thereon by the image forming apparatus 10 is conveyed to the finisher 20.

The finisher 20 performs post-processing for the sheet supplied from the image forming apparatus 10 and performs, for example, sort processing and staple processing. When necessary, the finisher 20 folds the sheet in two and discharges the sheet.

The finisher 20 shown in FIG. 1 has a stapling mechanism 21 for applying staple processing to a sheet bundle, a punching mechanism 31 for punching sheets, a sheet discharge tray 51, and a fixed tray 52.

The sheet discharge tray 51 is a movable type and receives the sheet bundle subjected to the staple processing. The stapling mechanism 21 includes an aligning device that aligns sheets, which are conveyed to the stapling mechanism 21, in a width direction. The stapling mechanism 21 can also sort and discharge the sheets using this aligning device.

When the post-processing such as stapling is not performed, the stapling mechanism 21 directly discharges the sheets conveyed from the image forming apparatus 10 to the sheet discharge tray 51 or the fixed tray 52 without applying any processing to the sheets.

The stapling mechanism 21 of the finisher 20 will be briefly explained. Sheets supplied from the image forming apparatus 10 via the punching mechanism 31 are received by inlet rollers 22 provided near a delivery port of the finisher 20. Sheet feeding rollers 23 are provided on a downstream side of the inlet rollers 22. Sheets P received by the inlet rollers 22 are stacked on a processing tray 24 via the sheet feeding rollers 23 and the like.

The sheets stacked on the processing tray 24 are guided to a stapler 25 and subjected to staple processing. A conveyor belt 26 for conveying the sheets P subjected to the sort processing and the staple processing to the sheet discharge tray 51 is provided.

The sheets P conveyed by the conveyor belt 26 are discharged to the sheet discharge tray 51. The sheet discharge tray 51 is lifted and lowered by a driving unit (now shown) to receive the sheets P.

The sheets P may be discharged to the sheet discharge tray 51 without being subjected to the staple processing. In this case, the sheets P are discharged without being dropped to the processing tray 24. It is also possible to discharge the sheets P for which the post-processing is unnecessary to the fixed tray 52. A conveying path is provided in order to guide the sheets P to the fixed tray 52. The conveying path is not shown in the figure.

The punching mechanism 31 will be explained. The punching mechanism 31 is arranged between the image forming apparatus 10 and the stapling mechanism 21 and has a punch unit 32 and a dust box 33.

The punch unit 32 is provided with a punching blade (not shown) for applying the punching processing to the sheets P. When this punching blade lowers, punch holes are opened in the sheets P. Punch dust generated by the punching processing falls into the dust box 33.

Moreover, an inserter 40 forming an essential part of the invention is provided between the image forming apparatus 10 and the finisher 20. The inserter 40 sequentially supplies sheets having images formed thereon to the finisher 20. This inserter 40 has a collating mechanism for, when plural types of sheets are inserted therein in a stacked state, sequentially delivering the sheets to the finisher 20 in a designated order. The collating mechanism will be described later.

The inserter 40 has a sheet feeding tray 41, a sheet feeding roller 42, and a back roller 43. Moreover, the inserter 40 has conveying rollers 53 and 54 for conveying the sheets P stored in the sheet feeding tray 41 to the punching mechanism 31 of the finisher 20.

Plural rollers 55 and 56 for sheet conveyance are provided on a path extending from the image forming apparatus 10 to the inlet rollers 22 of the stapling mechanism 21. The sheets P discharged from the image forming apparatus 10 are sent to the stapling mechanism 21 via the rollers 55 and 56. The sheets conveyed by the conveying rollers 53 and 54 of the inserter 40 are sent to the stapling mechanism 21 via the rollers 56.

Figure 2:
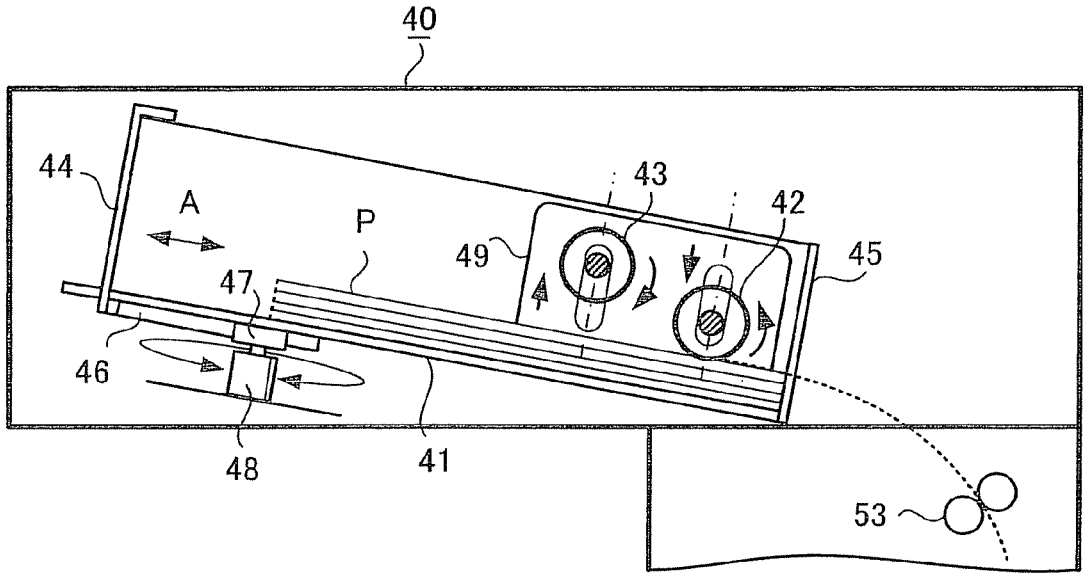
FIG. 2 is a diagram showing a structure of a main part of the sheet processing apparatus of the invention in enlargement.

FIG. 2 is a side view showing a structure of a main part of the inserter 40.

In FIG. 2, the sheet feeding tray 41 has an aligning plate 44 that aligns the trailing end of the sheets P and a shutter 45 that receives the leading end of the sheets P. The shutter 45 opens, for example, in an upward direction when the sheets P are discharged.

The aligning plate 44 is capable of moving in a conveying direction of the sheets P (an arrow A direction). In order to move the aligning plate 44 in the arrow A direction, a rack 46 formed integrally with the sheet feeding tray 41 and a pinion 47 that meshes with this rack 46 are provided. The aligning plate 44 is moved by rotating the pinion 47 with a motor 48. A belt mechanism and the like may be used as a moving mechanism for the aligning plate 44.

The sheet feeding roller 42 and the back roller 43 are provided orthogonal to the conveying direction of the sheets P, formed in a columnar shape, and driven to rotate by motors 71 and 72 (described later with reference to FIG. 5). The sheet feeding roller 42 and the back roller 43 are movable in a paper surface direction of the sheets P, i.e., a direction in which the stored sheets P are pressed, and a direction away from the sheets P.

The motors 71 and 72 that rotate the sheet feeding roller 42 and the back roller 43 and moving mechanisms for the sheet feeding roller 42 and the back roller 43 are attached to a plate 49. The sheet feeding roller 42 has a function of rotating counterclockwise in the figure to discharge the sheets P from the sheet feeding tray 41. The back roller 43 has a function of rotating clockwise in the figure to retract the sheets P in a direction opposite to the sheet feeding direction.

Figure 3:
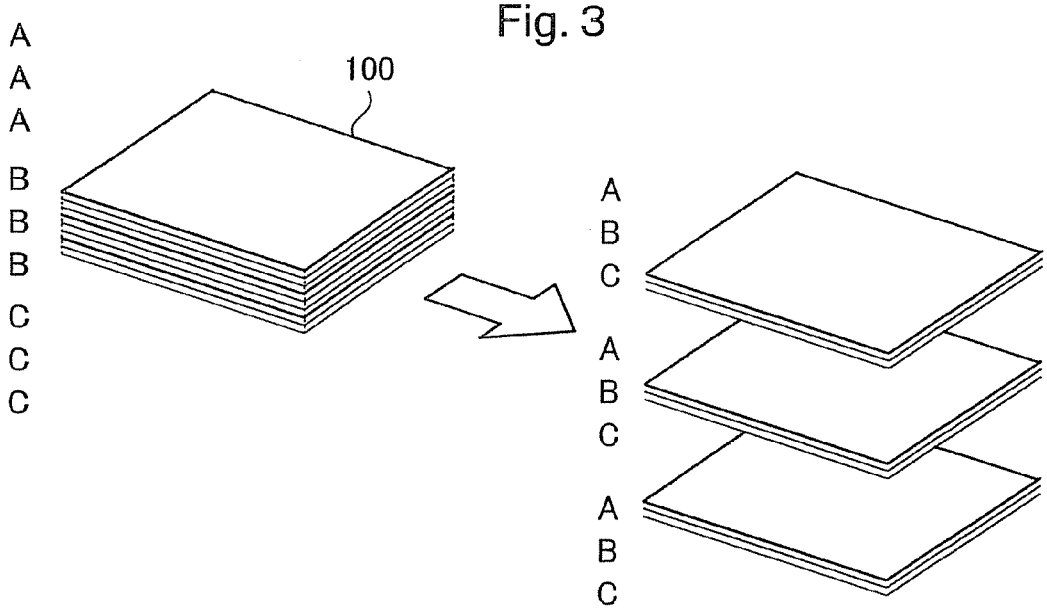
FIG. 3 is a schematic explanatory diagram for explaining a processing operation for sheets in the sheet processing apparatus of the invention.

The inserter 40 according to the invention performs a collating operation shown in FIG. 3. For example, when a sheet bundle 100 stacked for each of plural types in such as manner as AAA, BBB, and CCC are stored in the sheet feeding tray 41, the inserter 40 can select one sheet out of each of the plural types of sheets, combine the respective types in such a manner as ABC, ABC, and ABC, and discharge the sheets in good order.

FIGS. 4A to 4D and FIGS. 4E to 4H are diagrams for explaining operations in performing such collating.

Figure 4A:
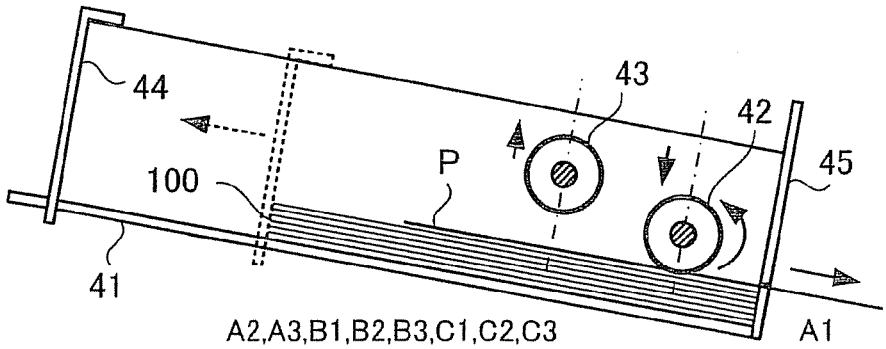
FIGS. 4A to 4H are explanatory diagrams for explaining operations of the sheet processing apparatus of the invention.

First, FIG. 4A shows a state in which three types of sheets A, B, and C are stacked in stages, for example, stacked in an order of A1, A2, A3, B1, B2, B3, C1, C2, and C3 and stored in the sheet feeding tray 41. Reference signs A1, A2, . . . represent a first sheet of a type A, a second sheet of the type A, and the like.

The types of the sheets mean sheets having images formed thereon on the basis of different originals, respectively, and do not mean sheet sizes and materials of the sheets.

When the sheet bundle 100 is stored in the sheet feeding tray 41, the aligning plate 44 moves the sheet bundle 100 to the shutter 45 side, aligns the sheet bundle 100, and returns to the original position. The sheet feeding roller 42 moves in a direction to the sheet bundle. The back roller 43 moves to a position apart from the sheet bundle.

In this state, the shutter 45 opens and the sheet feeding roller 42 rotates in the counterclockwise direction. Consequently, a sheet A1 at the top is discharged by the sheet feeding roller 42 and guided to the rollers 53 (see FIG. 2).

Figure 4B:
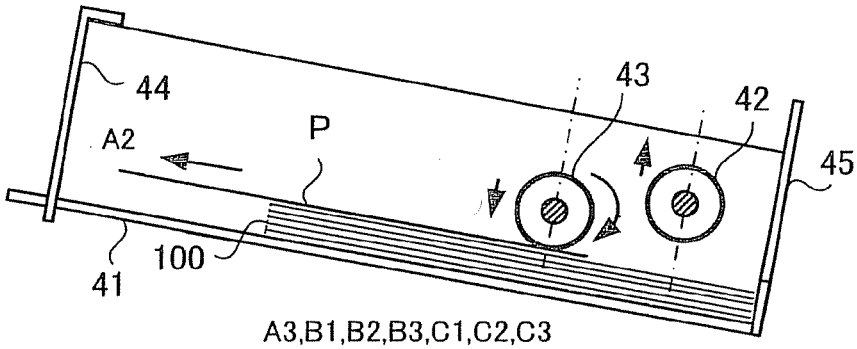
Figure 4C:
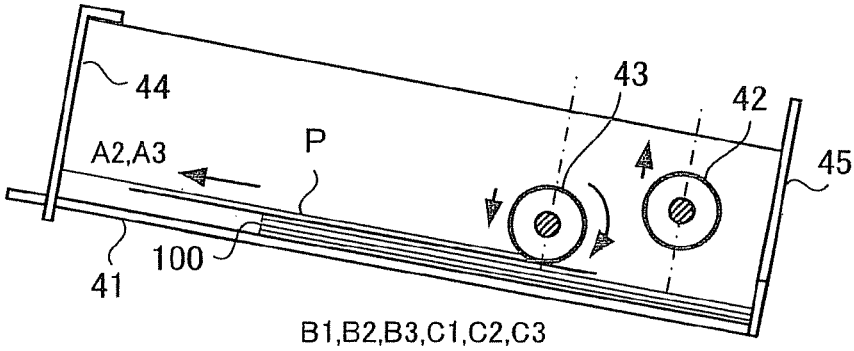

As shown in FIG. 4B, the back roller 43 moves in the direction to the sheet bundle 100 and the sheet feeding roller 42 moves to a position apart from the sheet bundle 100. In this state, the back roller 43 rotates in the clockwise direction. Consequently, a sheet A2 at the top of the sheet bundle 100 is retracted by the back roller 43. Moreover, as shown in FIG. 4C, the next sheet A3 is also sent to a retracted position by the back roller 43.

Figure 4D:
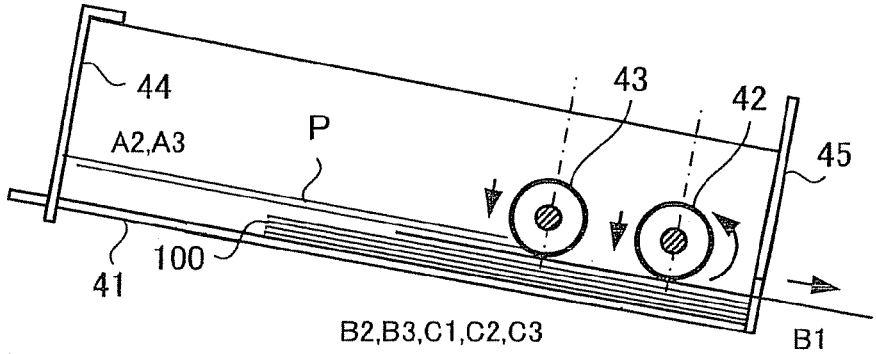

When the sheets A2 and A3 are retracted, as shown in FIG. 4D, the back roller 43 stops the rotation and the sheet feeding roller 42 moves in the direction to the sheet bundle 100 again. The sheet feeding roller 42 rotates in the counterclockwise direction and a sheet B1 of the next type is discharged.

Figure 4E:
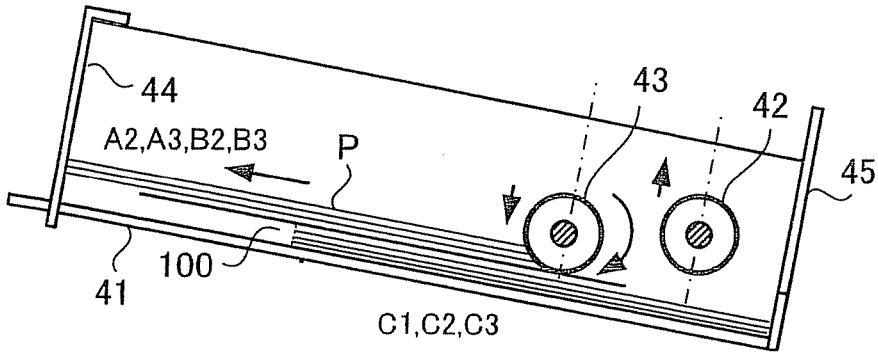

Moreover, as shown in FIG. 4E, the sheet feeding roller 42 moves to a position apart from the sheet bundle 100 and the back roller 43 rotates in the clockwise direction. Consequently, the next sheets B2 and B3 are sent to the retracted position by the back roller 43.

Figure 4F:
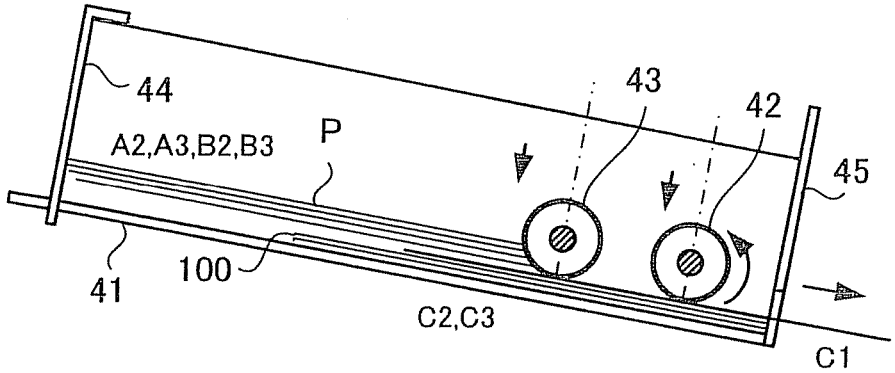

When the sheets B2 and B3 are retracted, as shown in FIG. 4F, the back roller 43 stops the rotation, the sheet feeding roller 42 moves in the direction to the sheet bundle 100 again and rotates in the counterclockwise direction, and a sheet C1 of the next type is discharged.

Figure 4G:
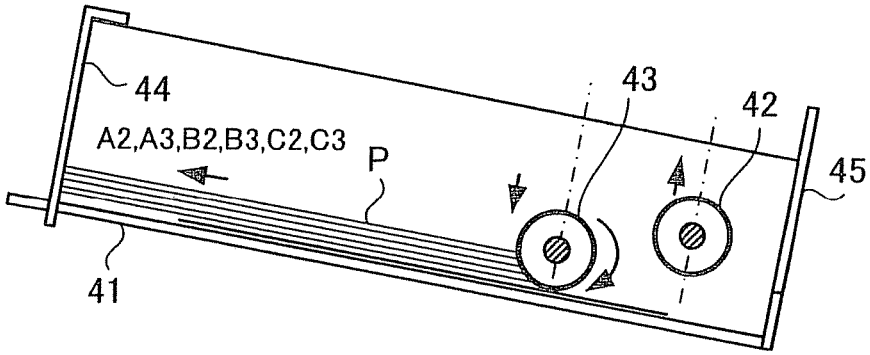
Figure 4H:
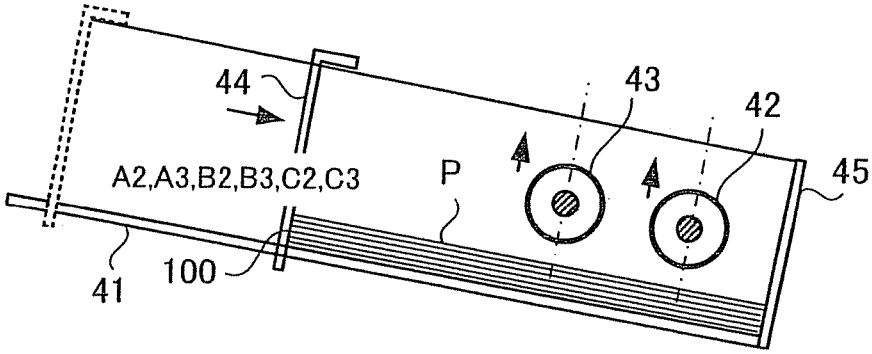

Thereafter, as shown in FIG. 4G, the sheet feeding roller 42 moves to a position apart from the sheet bundle 100 and the back roller 34 rotates in the clockwise direction. Consequently, the next sheets C2 and C3 are sent to the retracted position by the back roller 43. All the sheets A2, A3, B2, B3, C2, and C3 on the sheet feeding tray 41 are sent to the retracted position.

In this state, the shutter 45 closes and the sheet feeding roller 42 and the back roller 43 moves in the direction away from the sheet bundle 100. The motor 48 in FIG. 2 causes the aligning plate 44 to move to the shutter 45 side and align the sheet bundle 100 on the sheet feeding tray 41.

The sheet feeding roller 42, the back roller 43, and the shutter 45 return to the state in FIG. 4A to discharge the sheet A2 at the top of the sheet bundle 100. After that, the operations in FIGS. 4B to 4D and FIGS. 4E to 4H are repeated. However, the number of sheets retracted by the back roller 43 is reduced by one from the case described above and only the sheet A3 is retracted.

The sheet B2 is discharged and the sheet B3 is retracted and then the sheet C2 is discharged and the sheet C3 is retracted. The sheets A3, B3, and C3 remain in the sheet feeding tray 41. The aligning plate 44 is moved to the shutter 45 side to align the sheets and returned to the original position.

In this state, the sheet feeding roller 42, the back roller 43, and the shutter 45 returns to the state in FIG. 4A. However, since it is unnecessary to retract the sheets with the back roller 43 anymore, the sheet feeding roller 42 sequentially discharges the remaining sheets A3, B3, and C3.

The sheets discharged in the order of A1, B1, C1 . . . A3, B3, and C3 in this way are sent to the finisher 20, subjected to punching processing by the punching mechanism 31 when necessary, further subjected to staple processing by the stapling mechanism 21, and discharged to the sheet discharge tray 51.

In the example described above, the sheet bundle 100, in which the three pieces of each of the three types of sheets are stacked, is inserted in the sheet feeding tray 41. When a user operates an operation unit 70 (described later with reference to FIG. 5) provided in the inserter 40 to input "three types and three pieces", collating processing is performed. In the case in which five pieces of each of four types of sheets are stacked and inserted in the sheet feeding tray 41, when the user inputs "four types and five pieces", the collating processing is performed five times for each of the four types of sheets.

The inserter 40 performs, on the basis of inputted information "n types and m pieces", discharge, retraction, and alignment of sheets once, repeats the discharge, retraction, and alignment plural times, sequentially reduces the number of sheets to be retracted by one every time the discharge, retraction, and alignment is performed once, and performs only the discharge when the number of sheets to be retracted is reduced to zero.

A structure of a control system for the inserter 40 of the invention will be explained with reference to a block diagram in FIG. 5.

Figure 5:
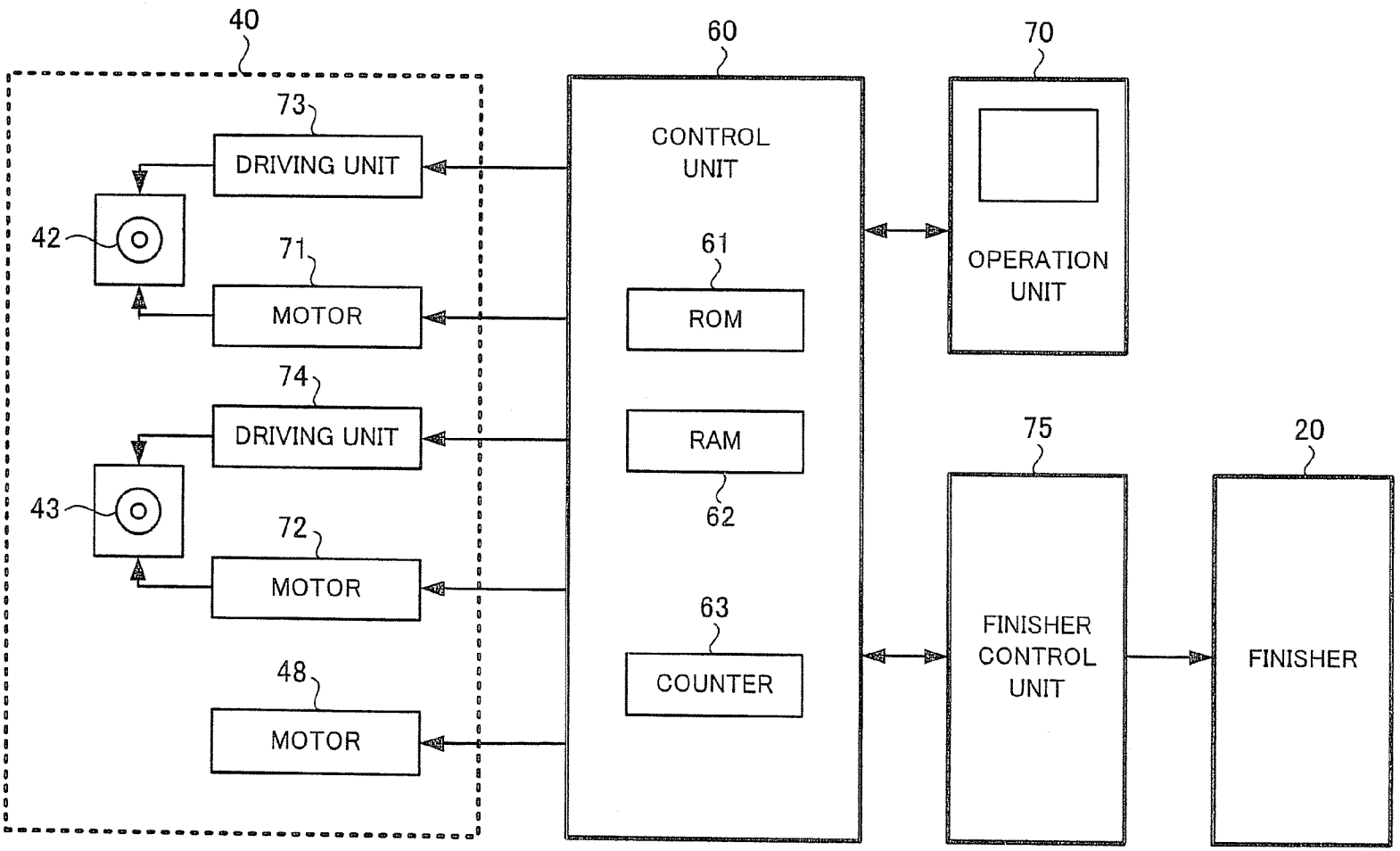
FIG. 5 is a block diagram showing a control system for the sheet processing apparatus of the invention.

In FIG. 5, a control unit 60 has, other than a CPU, a ROM 61, a RAM 62, a counter 63, and the like. The control unit 60 controls the inserter 40 in accordance with a control program stored in the ROM 61.

The control unit 60 is connected to the operation unit 70 and controls operations of the inserter 40 in response to operation from the operation unit 70. The RAM 62 is used for temporarily storing control data and used in arithmetic operation work at the time of control. Operations of the counter 63 will be described later.

The operation unit 70 includes, for example, plural keys or a display unit that also functions as a touch panel. The user operates the keys or the touch panel to input the types n and the pieces m of sheets to be inserted.

The inserter 40 has the motors 71 and 72 that drive to rotate the sheet feeding roller 42 and the back roller 43. Further, the inserter 40 has driving units 73 and 74 that control to move the sheet feeding roller 42 and the back roller 43 in directions toward and away from the sheet bundle 100, respectively. The control unit 60 controls these motors 71 and 72 and the driving units 73 and 74.

The control unit 60 controls the driving of the motor 48 to control a position of the aligning plate 44 of the inserter 40. Moreover, the control unit 60 controls opening and closing operations of the shutter 45.

The control unit 60 is connected to a finisher control unit 75 that controls the finisher 20. The finisher control unit 75 controls the stapling mechanism 21 and the like of the finisher 20. The finisher control unit 75 and the control unit 60 transmit information to each other. The inserter 40 and the finisher 20 operate in cooperation with each other.

As the control of the finisher 20 by the finisher control unit 75, there are stapling by the stapler 25, conveyance of the sheets P to the stapler 25, discharge of sheets after being stapled, and the like.

Figure 6:
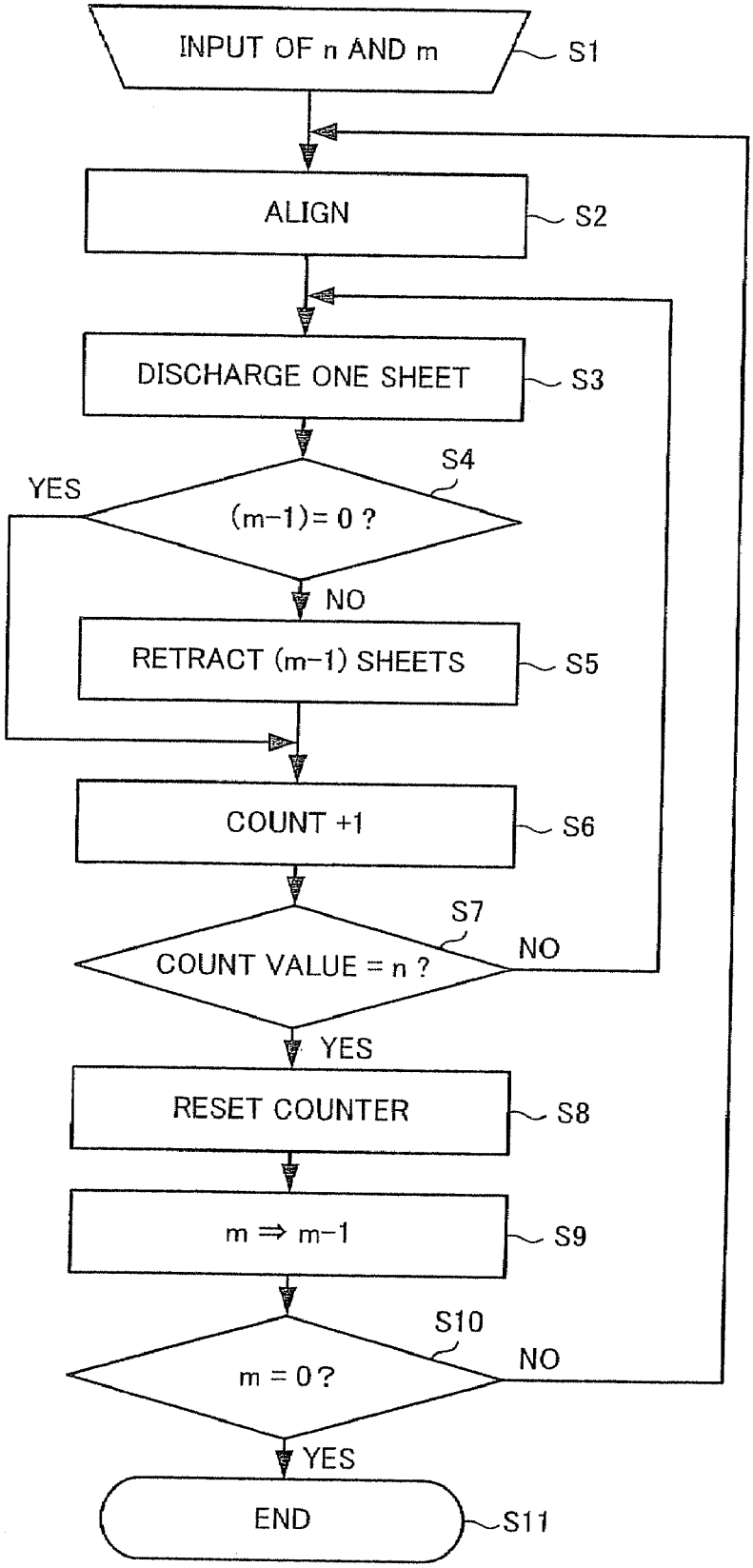
FIG. 6 is a flowchart for explaining operations of the sheet processing apparatus of the invention.

FIG. 6 is a flowchart for explaining the collating processing based on the control by the control unit 60. The collating processing will be explained together with the operations in FIGS. 4A to 4H.

Step S1 in FIG. 6 is a step in which the user operates the operation unit 70 to input the types n and the pieces m of sheets. The user inputs "n types and m pieces". In the example in FIGS. 4A to 4H, the user inputs n=3 and m=3.

Step S2 is a step of aligning the sheet bundle 100 stored in the sheet feeding tray 41 with the aligning plate 44. The next step S3 is a step of discharging one sheet at the top of the sheet feeding tray 41 with the sheet feeding roller 42. The step is equivalent to FIG. 4A.

In step S4, the control unit 60 determines whether (m−1) =0. When (m−1) is not 0, in the next step S5, the control unit 60 retracts (m−1) sheets with the back roller 43. In the case of m=3, the control unit 60 retracts two sheets. This step is equivalent to FIGS. 4B and 4C.

In the next step S6, the control unit 60 increments a value of the counter 63 by 1. In step S7, the control unit 60 determines whether a value of the counter 63 is n. An initial value of the counter 63 is 0 and counted up by +1 every time the operation from steps S3 to S5 is performed. Therefore, according to the loop from step S3 to step S7, the control unit 60 repeats the operation for discharging one sheet and retracting (m−1) sheets until the value of the counter 63 reaches n. This operation is equivalent to the operation from FIGS. 4A to 4G.

When the value of the counter 63 reaches n in step S7, the control unit 60 shifts to step S8. The value of the counter 63 is reset and returns to 0. In the next step S9, the control unit 60 changes the value m to m−1. When an input value is 3, m is changed to 2.

In the next step S10, the control unit 60 determines whether m=0. Unless m≠0, the control unit 60 returns to step S2 and performs the alignment processing. This operation is equivalent to FIG. 4H.

In step S3, the control unit 60 discharges one sheet at the top of the sheet feeding tray 41. In step S4, the control unit 60 determines whether (m−1)=0. When (m−1) is not 0, the control unit 60 shifts to the next step S5 and retracts (m−1) sheets with the back roller 43. Since the value m is changed to 2, in step S5, the control unit retracts one sheet.

The control unit 60 repeats the operation from steps S3 to S5 (for discharging one sheet and retracting one sheet) n times. When the value of the counter 63 reaches n in step S6, the control unit 60 shifts to step S8 through step S7. The value of the counter 63 is reset and returns to 0. In the next step S9, the control unit 60 changes the value m to m−1. In this case, the value m further decreases by 1 to 1.

In the next step S10, since m≠0, the control unit 60 returns to step S2 and performs the alignment processing again. In step S3, the control unit 60 discharges one sheet at the top of the sheet feeding tray 41.

In step S4, the control unit 60 determines whether (m−1)=0. In this case, since (m−1)=0, the step S5 is detoured and the retracting processing is not performed. In this case, the control unit 60 returns to step S3 through the next steps S6 and S7 and repeats discharge of one sheet n times.

When the value of the counter reaches n in step S6, the control unit 60 shifts from step S7 to step S8. The value of the counter 63 is reset and returns to 0. In the next step S9, the control unit 60 changes the value m to m−1. Therefore, the value m changed is 0. In step S10, the control unit 60 determined that m=0, shifts to step S1, and finishes the collating processing.

In this way, in the invention, when the sheet types n and the pieces m are inputted, the inserter 40 can automatically execute the collating processing.

The invention is not limited to the above explanation. Various modifications are possible without departing from the scope of claims. For example, as the finisher 20, a saddle stitcher may be provided other than the stapling mechanism 21. The saddle stitcher is an apparatus that bundles plural sheets supplied from the image forming apparatus 10 or plural sheets collated by the inserter 40 and folds the sheet bundle in two.

Although exemplary embodiments of the present invention have been shown and described, it will be apparent to those having ordinary skill in the art that a number of changes, modifications, or alterations to the invention as described herein may be made, none of which depart from the spirit of the present invention. All such changes, modifications, and alterations should therefore be seen as within the scope of the present invention.

What is claimed is:

1. A sheet processing apparatus comprising:

a sheet feeding tray capable of aligning and storing plural sheets;

a discharging member for discharging a sheet at a top of a bundle of the sheets aligned from the sheet feeding tray;

a retracting member for moving the sheet at the top of the sheet bundle to a position retracted in a direction opposite to a direction of the discharge; and a control unit configured to control operations of the discharging member and the retracting member, wherein when plural pieces of plural types of sheets are stacked and stored in the sheet feeding tray, the control unit controls the operations of the discharging member and the retracting member according to the types and the number of the sheets, discharges, for each of the types, a sheet located at the top of the sheet feeding tray and retracts remaining sheets, performs alignment again at a point when the discharge and the retraction are finished for all the types, and repeats this series of operations to sequentially discharge the sheets of the respective types.

2. A sheet processing apparatus according to claim 1, wherein the discharging member is a rotatable first roller for discharging the sheet at the top of the aligned sheet bundle from the sheet feeding tray, the retracting member is a rotatable second roller for moving the sheet at the top of the sheet bundle to the position retracted in the direction opposite to the discharging direction, and the first and the second rollers are movable in a direction of a paper surface of the sheet bundle and a direction away from the paper surface.

3. A sheet processing apparatus according to claim 2, wherein the first roller rotates in a first direction for discharging the sheets and the second roller rotates in a direction opposite to the first direction in order to retract the sheets, and the control unit rotates the first roller and stops the rotation of the second roller, when the sheets are discharged, and rotates the second roller and stops the rotation of the first roller, when the sheets are retracted.

4. A sheet processing apparatus according to claim 2, wherein the control unit moves the first and the second rollers to a position apart from the paper surface of the sheet bundle, when the sheet bundle is aligned.

5. A sheet processing apparatus according to claim 1, wherein the control unit repeats the series of operations of the discharge, the retraction, and the alignment of the sheets according to the types and the number of the sheets and reduces a number of the sheets to be retracted by one every time the operations are performed once.

6. A sheet processing apparatus according to claim 1, wherein the control unit performs, when the number of the types of the sheets is n, the alignment after performing the operations of the discharge and the retraction n times.

7. A sheet processing apparatus according to claim 1, wherein the sheet processing apparatus constitutes an inserter arranged between a pre-stage of a sheet post-processing apparatus and an image forming apparatus.

8. A sheet processing apparatus arrangeable between an image forming apparatus and a sheet post-processing apparatus, comprising:

a sheet feeding tray capable of storing plural sheets;

an aligning member that aligns a bundle of the sheets stored in the sheet feeding tray;

a rotatable first roller for discharging a sheet at a top of the sheet bundle aligned from the sheet feeding tray;

a rotatable second roller for moving the sheet at the top of the sheet bundle to a position retracted in a direction opposite to a direction of the discharge;

an operation unit configured to input information representing types of the sheet stored in the sheet feeding tray and a number of the respective types; and a control unit configured to control rotation of the first and the second rollers and control to move the first and the second rollers in a direction of a paper surface of the sheet bundle and a direction away from the sheet surface, wherein when plural pieces of plural types of sheets are stacked and stored in the sheet feeding tray, the control unit controls the rotation and the movement of the first and the second rollers on the basis of the information on the types and the number of the sheets, and, discharges, for each of the types, a sheet located at the top of the sheet feeding tray and retracts remaining sheets, performs alignment again at a point when the discharge and the retraction are finished for all the types, and repeats this series of operations to sequentially discharge the sheets of the respective types.

9. A sheet processing apparatus according to claim 8, wherein the control unit repeats the series of operations of the discharge, the retraction, and the alignment of the sheets according to the types and the number of the sheets and reduces a number of the sheets to be retracted by one every time the operations are performed once.

10. A sheet processing apparatus according to claim 8, wherein the control unit performs the alignment after performing the operations of the discharge and the retraction n times, when the number of the types of the sheets is n.

11. A sheet processing apparatus according to claim 8, wherein the sheet processing apparatus constitutes an inserter arranged between a pre-stage of the sheet post-processing apparatus and the image forming apparatus.

12. A sheet processing apparatus according to claim 8, wherein the sheet processing apparatus sequentially supplies sheets discharged from the sheet feeding tray to the sheet post-processing apparatus.

13. A sheet processing apparatus according to claim 8, wherein the sheet post-processing apparatus includes at least one of a stapler and a saddle stitcher.

14. A sheet processing method comprising:

stacking and storing plural pieces of plural types of sheets in a sheet feeding tray capable of aligning and storing plural sheets;

providing a discharging member that discharges a sheet at a top of a bundle of the sheets aligned from the sheet feeding tray and a retracting member that moves the sheet at the top of the sheet bundle to a position retracted in a direction opposite to a direction of the discharge;

inputting information representing types of the sheet stored in the sheet feeding tray and a number of the respective types;

controlling the discharging member and the retracting member on the basis of the information on the types and the number of the sheets;

discharging, for each of the types, a sheet located at the top of the sheet feeding tray and retracting remaining sheets;

performing alignment again at a point when the discharge and the retraction are finished for all the types;

repeating a series of operations of the discharge, the retraction, and the alignment of the sheets and reducing a number of sheets to be retracted by one every time the operations are performed once; and repeating the series of operations until no sheet is left on the sheet feeding tray to sequentially discharge the sheets of the respective types.

* * * * *